US007407372B2

(12) United States Patent
Guidry et al.

(10) Patent No.: US 7,407,372 B2
(45) Date of Patent: Aug. 5, 2008

(54) PROGRESSING CAVITY PUMP OR MOTOR

(75) Inventors: Michael Guidry, Hockley, TX (US); Ed Vaclavik, Houston, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 433 days.

(21) Appl. No.: 10/845,951

(22) Filed: May 14, 2004

(65) Prior Publication Data

US 2005/0254964 A1 Nov. 17, 2005

(51) Int. Cl.
*F01C 1/10* (2006.01)
*F03C 2/00* (2006.01)
*F04C 18/00* (2006.01)

(52) U.S. Cl. ..... 418/48; 418/153; 418/178; 415/72; 415/73; 366/51; 138/138; 138/139; 166/236; 417/410.3; 417/310; 277/504; 277/530; 277/636

(58) Field of Classification Search ..... 418/48, 418/153, 178, 104; 415/72, 73, 76; 416/176, 416/177; 366/51; 138/138, 139, 143, DIG. 1; 166/236, 105, 107; 175/107; 277/204, 530, 277/636, 504; 417/410.5, 310
See application file for complete search history.

(56) References Cited

U.S. PATENT DOCUMENTS 3,280,753 A * 10/1966 Zimmer ..... 418/48
4,755,115 A * 7/1988 Akaike ..... 418/48
5,318,416 A * 6/1994 Hantschk et al. ..... 418/48
7,131,827 B2 * 11/2006 Jager ..... 418/48

FOREIGN PATENT DOCUMENTS

DE 2541779 A * 3/1977 ..... 418/48
DE 3119568 A1 * 12/1982 ..... 418/48
DE 3322095 A1 * 12/1984 ..... 418/48
GB 2081812 A * 2/1982 ..... 418/48
JP 61180512 A * 8/1986

* cited by examiner

*Primary Examiner*—Theresa Trieu
(74) *Attorney, Agent, or Firm*—Browning Bushman P.C.

(57) ABSTRACT

A progressing cavity pump or a motor includes, in one embodiment, an outer tube 12, an inner tube 14, and a plurality of apertures 16. A pair of annular seal glands 18 seal the stator material to the outer tube. The stator material is injection molded into the inner tube and passes through the plurality of apertures and into an annular gap between the inner tube and the outer tube. In other embodiments, the outer housing for a progressing cavity pump or motor is provided with one or more grooves, with each groove having an outer surface radius less than the outer housing surface radius. A plurality of apertures are provided in fluid communication with the grooves. According to the method of the invention, the stator material is injected into the apertures and fills a space radially outward of the apertures to bond the stator materiaal to the outer housing.

22 Claims, 9 Drawing Sheets

PROGRESSING CAVITY PUMP OR MOTOR

FIELD OF THE INVENTION

The present invention relates to a progressing cavity pump or motor. More particularly, this invention relates to an improved techniques for mechanically connecting the elastomeric stator with the outer tube or housing of the pump or motor.

BACKGROUND OF THE INVENTION

Progressing cavity pumps and motors have been used for decades in pumping and hydraulic motor applications. The typical assembly consists of a rigid rotor which resembles a screw having multiple leads. The rotor mates with a stator which has one additional lead cut on the interior of the stator. The differences in the leads form cavities between the rotor and the stator. These cavities continually progress from one end of the stator to the other when the rotor is turned. Operation of the pump is achieved by mechanically turning the rotor, while operation as a motor is achieved by forcing fluid into the end cavity to turn the rotor.

A stator is conventionally an elastomeric or plastic material which is formed by injection molding into the outer sleeve-shaped tube or housing. The elastomeric or plastic material is conventionally bonded with the tube, typically with an adhesive for a polymeric stator, and by welding for a metal stator insert. The bond provides a fluid seal between the stator material and the outer tube or housing.

The use of metal stator inserts is substantially limited in progressing cavity pumps and motors. The use of an adhesive for bonding the plastic or elastomeric material of a stator to the outer housing limits the use of the stator to an operational temperature and chemical environment required by the adhesive. Accordingly, the use of progressing cavity pumps and motors with a plastic or elastomeric stator has heretofore been limited.

The disadvantages of prior art are overcome by the present invention, and an improved progressing cavity pump or motor is hereinafter disclosed.

SUMMARY OF THE INVENTION

The progressing cavity pump or motor of the present invention provides a mechanical connection of the stator material and the outer tube or housing, thereby eliminating the need for an adhesive. By eliminating the need for an adhesive, the operational uses of the progressing cavity pump and motor are substantially expanded.

In one embodiment, a progressing pump or motor comprises an outer sleeve-shaped tube, a stator within the outer tube, and a rotor for rotating within the stator. An inner tube is spaced radially between an outer surface of the stator and the inner surface of the stator, with the inner tube including a plurality of apertures each filled with stator material. One or more annular seal glands may be secured to an inner surface of the outer tube and an outer surface of the inner tube to position the outer tube in its desired location when the stator material is installed, and to seal the stator to the outer tube.

In another embodiment, the progressing cavity pump or motor comprises an outer housing, a stator within the outer housing, and a rotor for rotating within the stator. At least one groove is provided in an outer surface of the outer housing, with the groove outer surface diameter being less than the housing outer surface diameter. The plurality of apertures are each in fluid communication with the at least one groove and are each filled with stator material. In one embodiment, the at least one groove comprises a plurality of axially extending grooves. In another embodiment, the at least one groove comprises a plurality of axially spaced circumferential grooves. In still another embodiment, the groove comprises a circumferential groove along a substantial length of the outer housing, with the apertures provided at selected locations along the groove.

In yet another embodiment, a progressing cavity pump or motor comprises an outer housing, a stator molded within the outer housing and a rotor for rotating the stator. A plurality of annular seal glands are each fixed to the housing for sealing between the housing and the stator material. Each annular seal gland may include an axially extending lip, such that the stator material fills the gap between the lip and the housing and seals with the housing. The lip of each annular seal gland may be axially extending toward a center portion of the housing.

A feature of the present invention is that the stator material may be installed in the outer tube or housing by a molding process.

As a further feature of the invention, each of the one or more annular seal glands may be secured to the outer tube and the inner tube by welding.

Each of the annular seal glands preferably includes an axial extending lip, such that the stator material fills the gap between the lip and the outer tube or housing and seals between the annular seal gland and the outer tube or housing. A pair of seal glands may be provided, each positioned adjacent an end of the inner tube or the ends of the one or more grooves, with each axially extending lip extending toward a center portion of the outer tube or housing. One or more intermediate annular seal glands may also be provided between the pair of annular seal glands.

These and further features and advantages of the present invention will become apparent from the following detailed description, wherein reference is made to the figures in the accompanying drawings.

DETAILED DESCRIPTION OF DRAWINGS

DETAILED DESCRIPTION OF PREFERRED EMBODIMENTS

Figure 1:
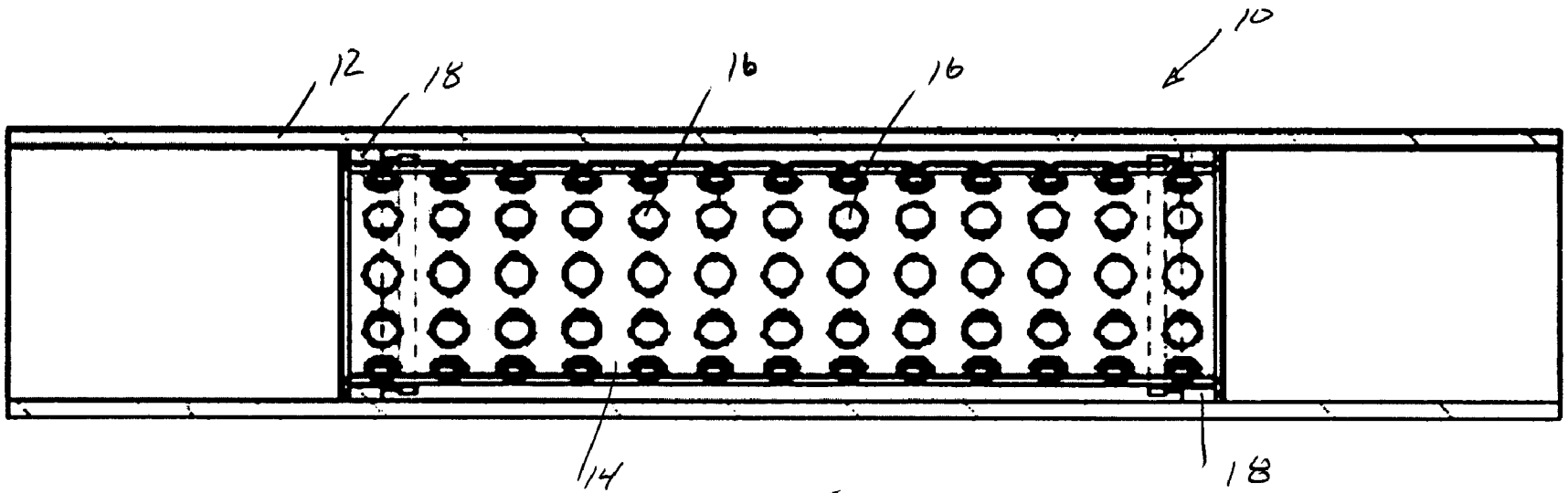
FIG. 1 is the side view of an outer tube of a progressing cavity pump or motor and an inner tube positioned within the outer tube.

FIG. 1 discloses a progressing cavity pump or motor 10 having an outer sleeve-shaped tube 12 and an inner tube 14 spaced radially within the outer tube. The inner tube 14 includes a plurality of apertures 16, which may comprise a regular pattern of rows and columns as shown in FIG. 1. A pair of annular seal glands 18 are each secured to the inner surface of the inner tube and the outer surface of the outer tube, and position the inner tube when the elastomeric material of the stator is installed. Annular seal glands may be fixed at the desired locations along the axial length of the inner tube as needed to provide proper structural support. As explained subsequently, the annular seal glands provide a fluid seal between the stator and the outer tube. Although not shown in the figures, those skilled in the art will appreciate that the outer tube 10 and the housing discussed subsequently are conventionally threaded at the outer surface of their ends for attachment to conventional tubulars or other downhole tools.

Figure 2:
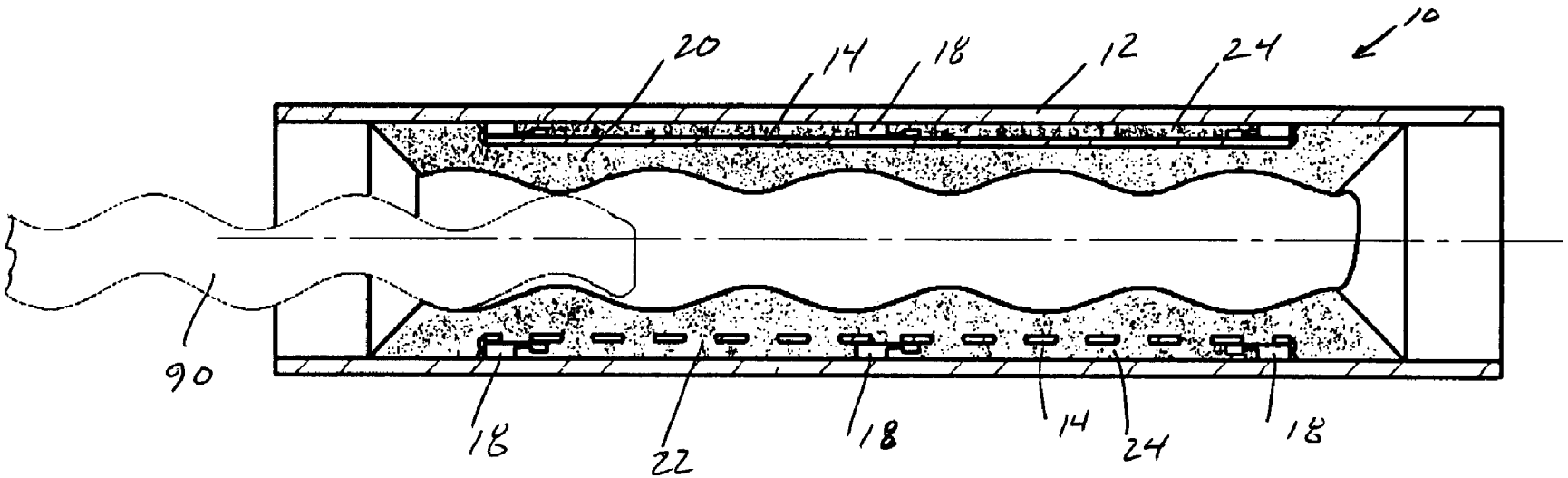
FIG. 2 is a cross sectional view of pump and motor components similar to those shown in FIG. 1, with a stator injection molded in the outer tube, and a portion of a rotor for positioning in the stator.

Referring to FIG. 2, the material for the stator 20 is conventionally molded into the outer tube 12. As shown in FIGS. 1 and 2, the inner tube 14 has a substantially uniform diameter along its length, and includes a plurality of radially extending through apertures 16. The stator material is thus forced radially outward by pressure through the apertures 22 in the inner tube, and also into the annular space 24 between the inner tube and the outer tube. Stator material thus at least substantially fills the gap between the outer surface of tube 14 and the inner surface of tube 12. Finally, the stator material is forced into the annular gap between each annular seal gland and the outer tube. The injected stator material may be a thermo-plastic, a plastic or a metal material which is injected under high pressure into the outer tube 12. The inner tube 14 thus has sufficient structural integrity to withstand the high pressure involved in injecting the stator material into the tube 12. FIG. 2 also depicts a short section of a rotor 90 for positioning within the stator.

Figure 3:
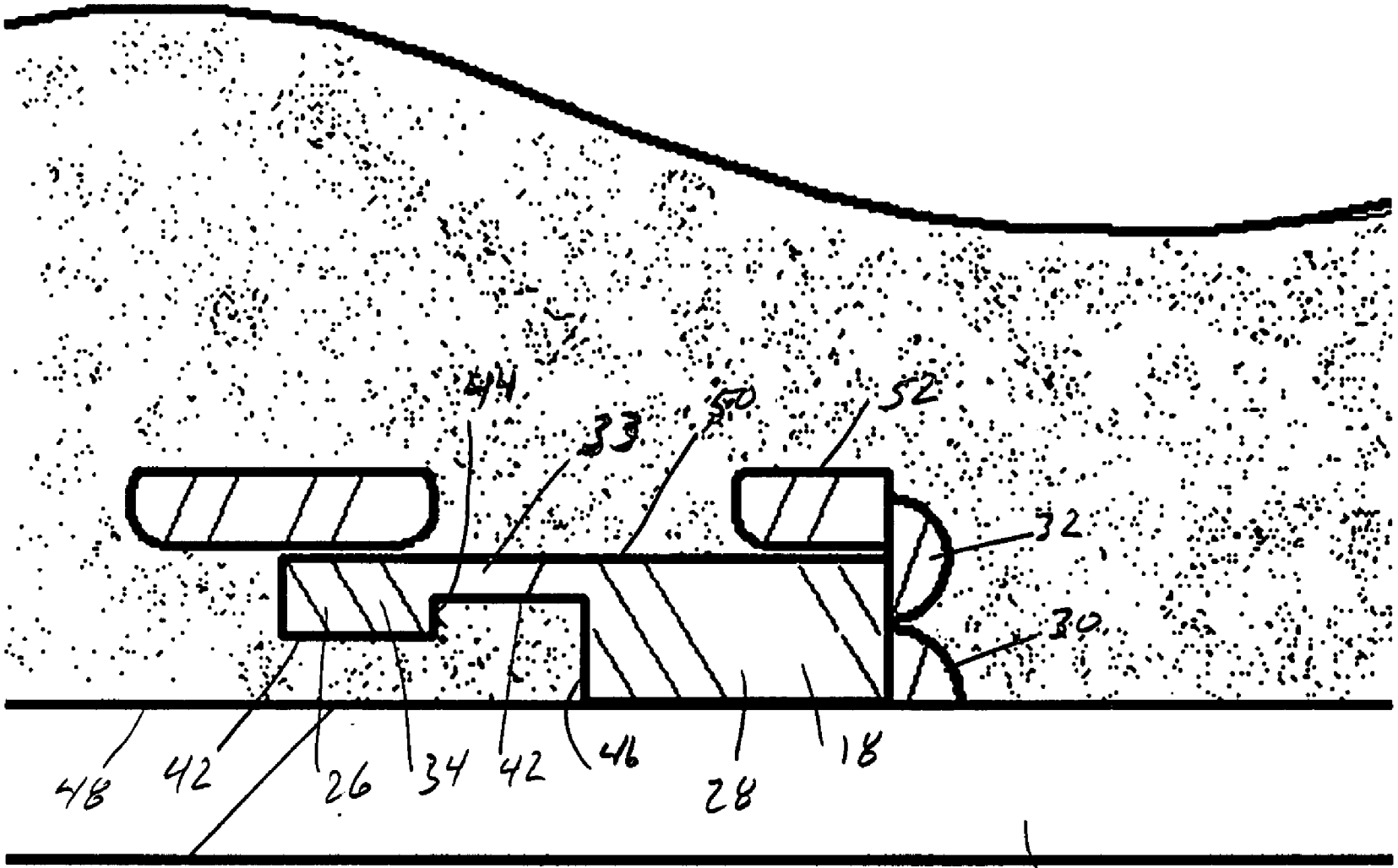
FIG. 3 is a detailed cross sectional view of a annular seal gland between the outer tube and the inner tube.

Referring to FIG. 3, each of the one or more annular seal glands 18 may include an axially extending lip 26 spaced radially from the outer tube 12 and extending axially from ring body 28, such that the stator material fills the annular gap between the lip and the outer tube and seals between the annular seal gland and the outer tube. A pair of annular seal glands may be provided adjacent to the ends of the inner tube, and each axially extending lip extends toward a center portion of the outer tube 12. Additional annular seal glands may be spaced between the pair of annular seal glands to provide added support, as shown in FIG. 2. FIG. 3 shows a weld 30 between the outer tube and the annular seal gland, and another weld 32 between the annular seal gland and the end of the inner tube.

In a preferred embodiment of the annular seal gland, the axially extending lip 26 provides an end section 34 which is radially thicker than a central section 33, thereby forming an annular recess radially outward of central section 33 for receiving stator material. Each sealing ring provides for low pressure sealing of the elastomeric stator 20 with the outer sleeve 12. If the molded material shrinks due to curing, temperature change or chemical exposure, then a fluid seal is created with the radially exterior faces 42 and 44. If the molded expands, a fluid seal is formed with the radially interior faces 46, 48, 50 and 52. Sealing at high pressure is accomplished by the interior fluid pressure compressing the molded material against the interior faces. Whether under low pressure or high pressure, a reliable fluid tight seal is formed between the stator and the outer tube 12.

The inner tube 14 provides substantial mechanical support for the material of the stator 20 during use of the pump or motor 10. More particularly, the overall shape of the stator material is desirably maintained by the mechanical connection between the inner tube 14 and the stator material, which flows through the apertures and into the annular space 24 between the inner tube 14 and the outer tube 12. A radially outward portion of the stator material is thus mechanically connected or locked to the inner tube, and the stator material near the ends of the inner tube are effectively sealed to the outer tube 12 by the annular seal glands 18.

In one embodiment, the radial outer surface of the inner tube may be spaced from 3/16 inch to 5/16 inch from the outer surface of the outer tube, thereby providing a substantial space 24 for receiving stator material which flows through the apertures 22 in the inner tube. The through apertures 16, as shown in FIG. 1, may be spaced in an axially extending rows and circumferentially spaced columns.

In another design, an outer housing of a progressing cavity pump or motor is provided with one or more grooves in an outer surface of the outer housing, with the groove or grooves having an outer surface radius less than the outer housing surface radius.

Figure 4:
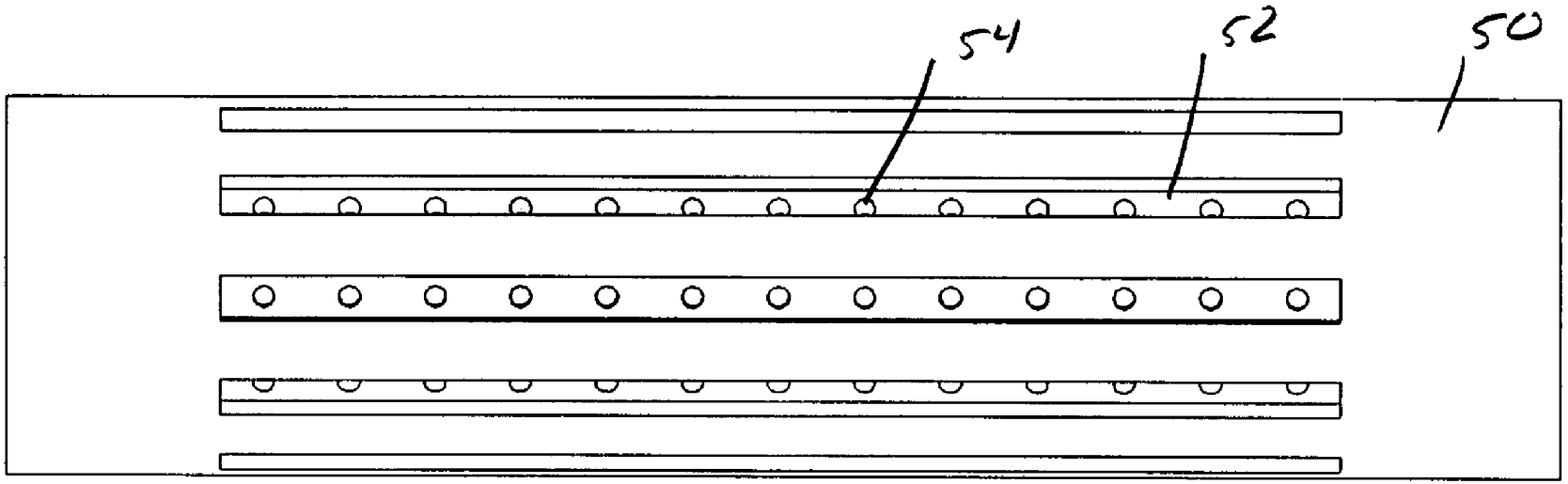
FIG. 4 is a side view of an outer housing of a progressing cavity pump or motor with elongate axially extending slots.
Figure 5:
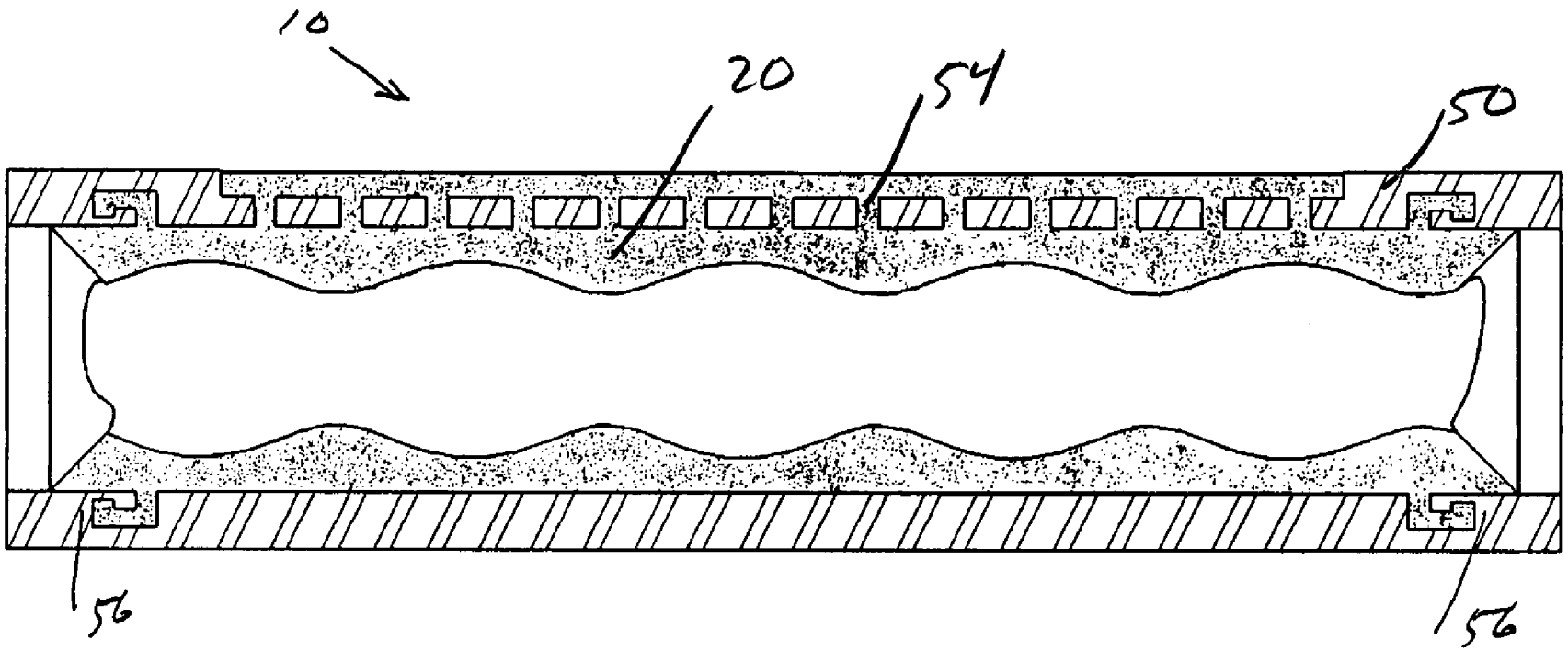
FIG. 5 is a cross sectional view of the pump and motor components shown in FIG. 4, with a stator injection motor within the housing.

In FIG. 4, a plurality of axially extending grooves 52 each have the plurality of through apertures 54 therein, such that the grooves are each in fluid communication with a plurality of apertures. The cutting of the grooves in the outer housing 50 thus allows stator material to both flow through the apertures 54, and to fill the gap radially outwardly of the reduced thickness housing formed by the grooves. Each of the grooves could have a groove axis generally parallel to the housing axis, or the grooves could be both axially extending and spiraling about the housing. FIG. 5 shows a pair of annular seal glands provided at each end of the housing 50. The annular seal glands are integral with the housing 50, but otherwise serve the same function of assuring a reliable seal between the elastomeric material 20 and the outer housing 50. The ring body is now part of the outer housing 50, and the lips 56 of the annular seal glands preferably are directed toward a center portion of housing 50.

Figure 6:
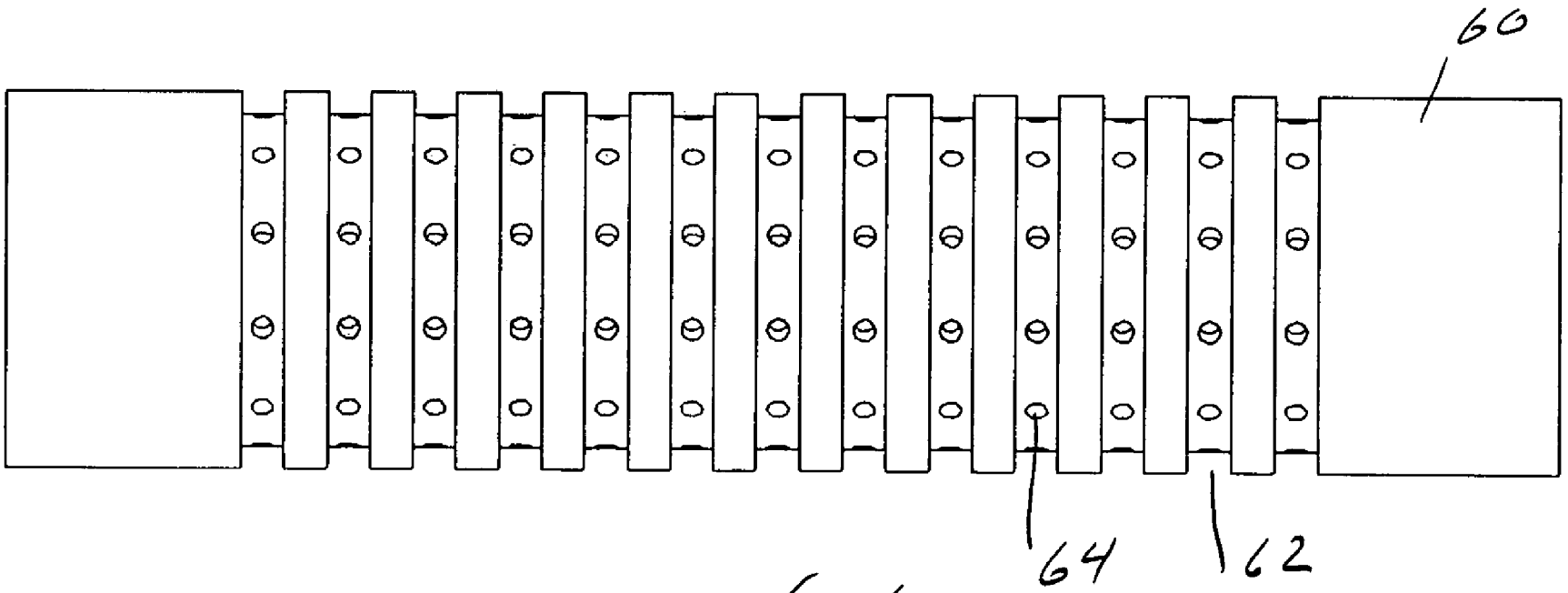
FIG. 6 is a side view of an alternative outer tube of a progressing cavity pump or motor with a plurality of axially spaced circumferential grooves in the outer tube.
Figure 7:
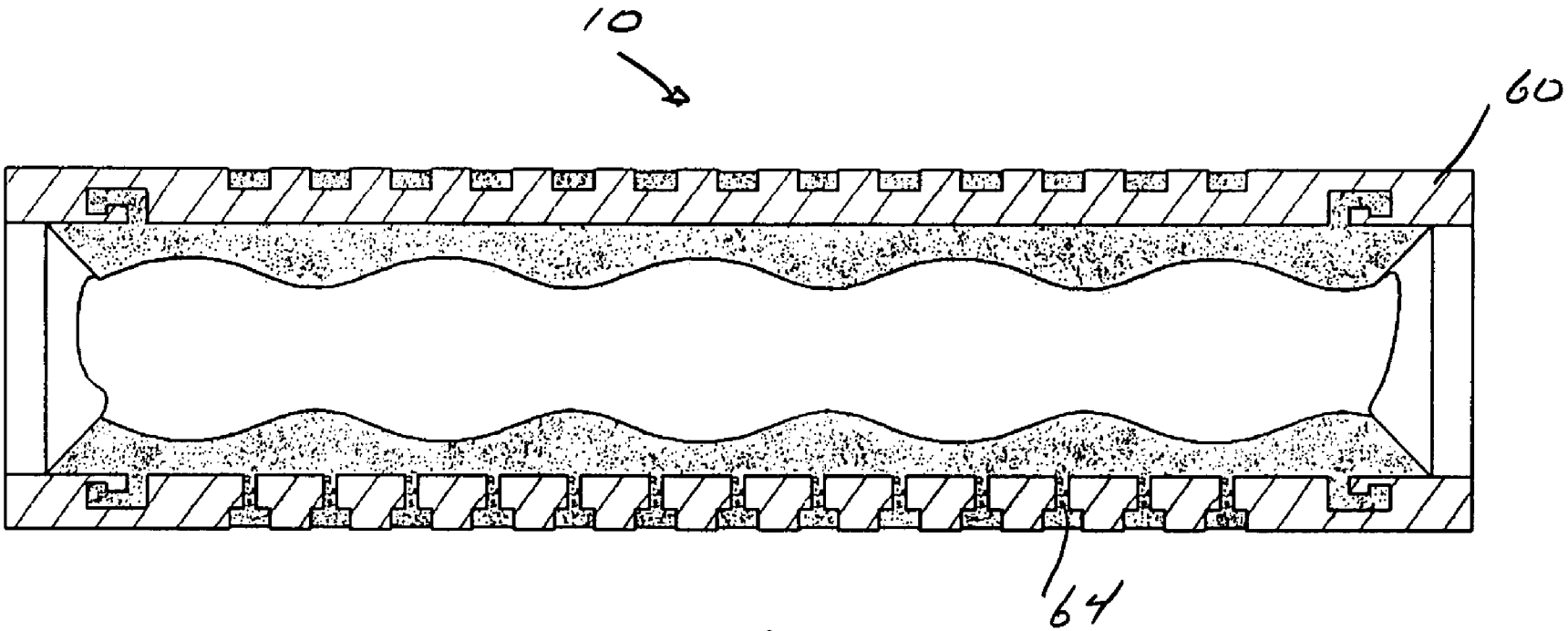
FIG. 7 is a cross sectional view of the pump and motor components as shown in FIG. 6, with a stator injection molded in the outer housing.

FIG. 6 shows an outer housing 60 for a progressing cavity pump or motor, with a plurality of circumferential grooves 62 spaced along a substantial axial length of the housing 60, and a plurality of through apertures 64 provided in each of the circumferential grooves. FIG. 7 shows the same housing with an stator material filling the apertures 64 and forming exterior rings of stator material about the outer housing. Annular seal glands are provided at each end of the housing. The circumferential grooves could each have a groove axis perpendicular to the housing axis, or the groove or grooves could be circumferential grooves which spiral down the length of the housing.

Figure 8:
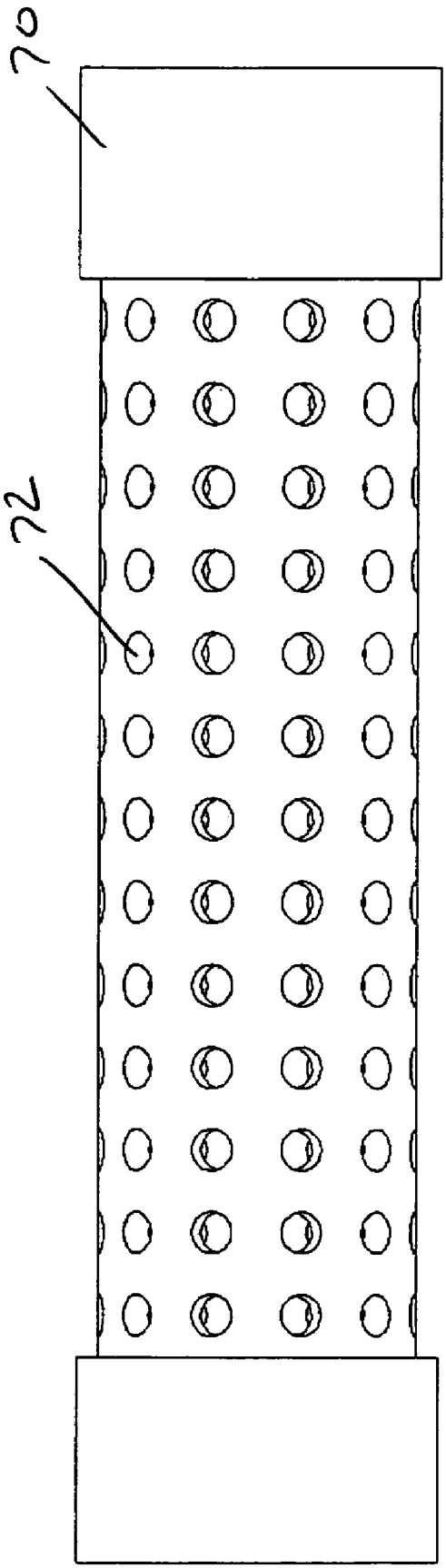
FIG. 8 is a side view of an outer tube of a progressing cavity pump or motor with an elongate circumferential slot in the outer tube.

FIG. 8 shows another embodiment of outer housing 70 with a plurality of apertures 72 arranged in axially extending rows and circumferentially extending columns. This design thus incorporates a substantially elongate and continuous circumferential groove rather than a plurality of grooves cut in the outer surface of the housing 70. In the alternative, a tube with a plurality of apertures may be welded or otherwise secured to a pair of housing end members having a slightly larger diameter than the tube, thereby avoiding the expense of cutting the groove in the outer housing.

Figure 9:
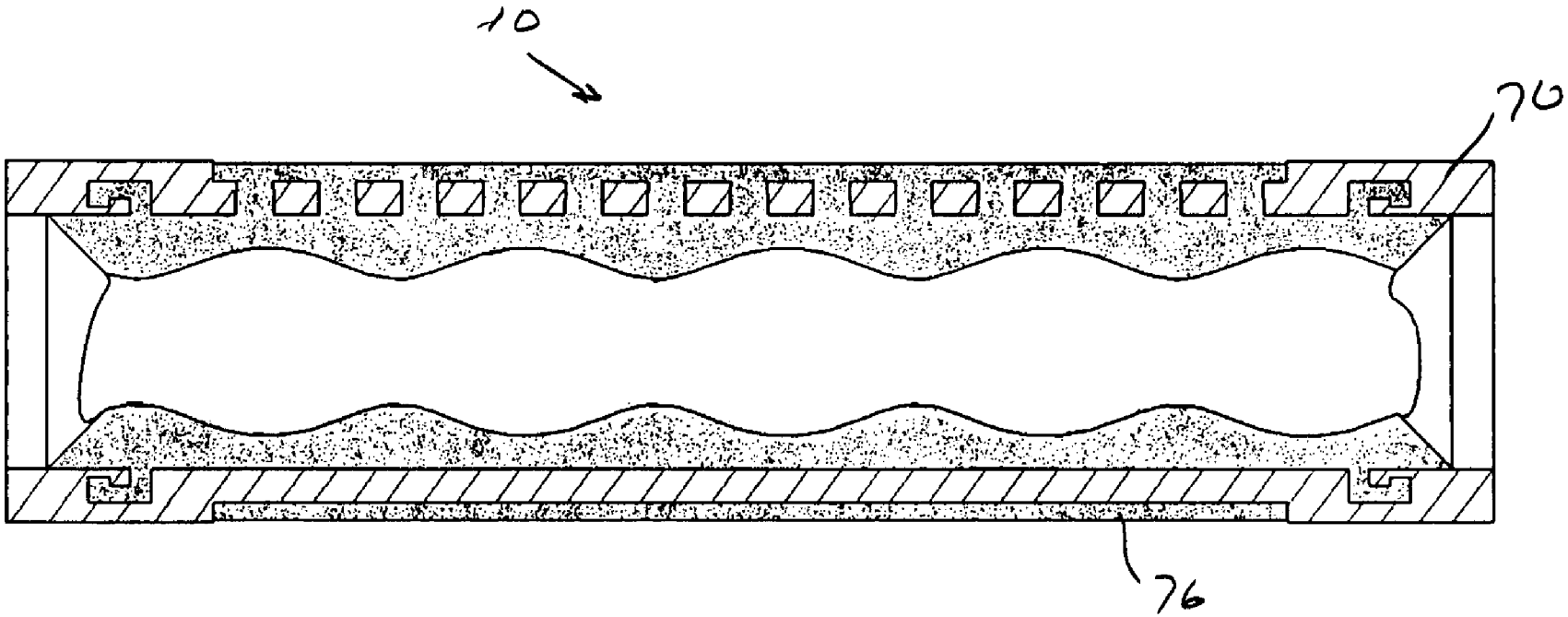
FIG. 9 is a cross sectional view of the pump and motor components as shown in FIG. 8, with a stator injection molded in the outer housing.

FIG. 9 shows the housing 70 filled with stator material, and also depicts a pair of annular seal glands adjacent to the end of the housing 70. Stator material flows through the ports 72 and occupies the space between the outer surface of the reduced radius groove and the outer surface of the outer housing, thereby effectively forming an stator material sleeve 76 radially outward of the apertures 72.

During the injection molding of the stator, a sleeve of the mold (not shown) may be provided over the outer housing for the embodiments as shown in FIG. 4-9 to contain the stator material, so that the stator material does not migrate radially outward from an outer surface of the housing during the molding process. The stator material may thus be flush with the outer surface of the housing, but may also be slightly recessed with respect to the outer surface of the housing to better protect the stator material when the pump or motor is placed downhole. In preferred embodiments, the stator material may be recessed with respect to the outer surface of the housing as shown in FIGS. 5, 7 and 9 a radial spacing of approximately ⅛ inch or slightly more to protect the stator material. A plastic treated metal or fabric weave material may be bonded to the radially outer surface of the stator material to add strength and reduce stator deterioration when placed downhole. In addition, various slats, rings, and other members may be used to cover over the exposed stator material to better protect the stator material when it is placed downhole.

It should be pointed out that the apertures disclosed herein may each have a circular cross section as shown, but may have other cross sections, including oval, slotted, or rectangular apertures. More particularly, an oval or slotted shape allows orientation of the apertures with the directional forces imparting to the molded material. Apertures also need not have a uniform cross-section along their radial length, and instead may be tapered or otherwise configured to accomplish the purposes set forth therein.

For each of the embodiments shown in FIGS. 5, 7 and 9, the combination of the reduced radius groove or grooves in the outer surface of the housing and the apertures in fluid communication with the grooves provides the desired mechanical support for the stator material, while the material is sealed to the ends of the housing by the annular seal glands. The stator material thus flows through and radially outward of the apertures, and when cured provides a substantial mechanical bound between the outer tube and the stator material, so that no adhesive for bonding the stator material to the outer housing is required. In other embodiments, it may be desirable to also use an adhesive material between the stator material and the interior surface of the housing at locations which do not have through apertures, e.g., at the ends of the housing.

The selected material for the stator will largely depend upon the intended application for the downhole pump and motor. In some embodiments an elastomeric material stator may be suitable. In other embodiments, a high strength plastic or polymeric material stator would be required. Polymeric and elastomeric materials include various types of rubbers and plastics, including reinforced rubber and plastic materials. In still other embodiments, a cast metal stator may be desired to withstand the high operating temperatures. In each of the embodiments, the stator is injected under high pressure into the outer tube or housing, with the outer tube or tubular housing serving as a partial mold for the injected material.

An annular seal gland as shown in FIG. 3 may be conventionally formed by a machining operation, and welded or otherwise secured to both the outer tube 12 and the inner tube 14, as discussed above. When providing the annular seal glands in the body of the outer housing, one or more components of the annular seal gland may be separately manufactured from the outer housing, then welded or otherwise secured in placed to produce the desired configuration as shown in the drawings.

The progressing cavity pump or motor has been discussed in detail above with respect to the features for mechanically bonding the stator material to the outer tube or the housing. Although the apertures in the inner tube or in a portion of the housing wall are convenient for mechanically connecting the stator material to the outer tube or the housing, other techniques may be used to mechanically connect the stator material to the housing, such as ribs or rails on the inside of the housing. A particular feature of the invention, however, is the ability to reliably seal between the outer housing and the stator material utilizing a one or more annular seal glands as disclosed herein. Regardless of the technique used to mechanically connect the stator material to the housing, two or more stator rings may thus be reliably used to seal the stator material to the outer housing. In some applications, a number of annular seal glands may be provided along the length of the housing, and may also serve to mechanically connect the stator material to the outer housing.

The foregoing disclosure and description of the invention is illustrative and explanatory of preferred embodiments. It would be appreciated by those skilled in the art that various changes in the size, shape of materials, as well as in the details of the illustrated construction or combination of features discussed herein may be made without departing from the spirit of the invention, which is defined by the following claims.

The invention claimed is:

1. A progressing cavity pump or motor, comprising:

an outer sleeve-shaped tube;

a stator material molded within the outer tube, an interior surface of the stator material having a non-cylindrical configuration;

a rotor for rotating within the stator;

an inner tube spaced radially between an outer surface of the stator and an inner surface of the stator, the inner tube having a substantially uniform diameter along its axial length and including a plurality of radially extending through apertures each filled with stator material; and one or more annular seal glands positioned between an outer surface of the inner tube and an inner surface of the outer tube for sealing the stator material to the outer tube, the seal gland positioned adjacent an end of the inner tube and including an axially extending lip extending from a seal gland base toward a center portion of the inner tube.

2. A progressing cavity pump or motor as defined in claim 1, wherein the one or more annular seal glands is secured to each of the outer tube and the inner tube by welding.

3. A progressing cavity pump or motor as defined in claim 1, wherein the one or more annular seal glands includes an axially extending lip spaced radially from the outer tube, such that the stator material fills in a gap between the lip and the outer tube and seals between the annular seal gland and the outer tube.

4. A progressing cavity pump or motor as defined in claim 1, wherein the one or more annular seal glands comprise a pair of annular seal glands, each annular seal gland positioned adjacent on end of the inner tube, and each axially extending lip extending toward a center portion of the inner tube.

5. A progressing cavity pump or motor as defined in claim 4, wherein the one or more annular seal glands comprise one or more intermediate annular seal glands spaced between the pair of annular seal glands adjacent the ends of the inner tube.

6. A progressing cavity pump or motor as defined in claim 1, wherein the plurality of through apertures are spaced in axially extending rows and circumferentially spaced columns.

7. A progressing cavity pump or motor as defined in claim 1, wherein the stator is one of a polymeric, elastomeric, or plastic material installed in the outer tube by an injection molding process.

8. A method of securing a molded stator material within an outer tube or housing of a progressing cavity pump or motor including a rotor for rotating within the stator, a method comprising:

one of spacing an inner tube radially within the outer tube and forming one or more radially inward grooves in an outer surface of the housing;

positioning one or more annular seal glands positioned between an outer surface of the inner tube and an inner surface of the outer tube for sealing the stator material to the outer tube, each seal gland positioned adjacent an end of the inner tube and including an axially extending lip extending from a seal gland base toward a center portion of the inner tube;

providing a plurality of radially extending apertures in the one of the inner tube and in the housing in fluid communication with the one or more grooves, the inner tube having a substantially uniform diameter along its axial length; and injecting the stator material into the one of the outer tube and the housing and through the plurality of apertures, such that the stator material fills the apertures and a space radially outward of the apertures.

9. A method as defined in claim 8, further comprising:

securing the one or more annular seal glands to one of the inner tube and the housing each for sealing between the stator material and one of the outer tube and the housing.

10. A method as defined in claim 8, further comprising:

providing the plurality of apertures in axially extending rows and circumferentially spaced columns.

11. A method as defined in claim 8, wherein the at least one groove comprises one of a plurality of circumferentially spaced grooves extending axially along the length of the housing, one or more circumferential grooves axially spaced along the length of the housing, and an axially elongate groove formed circumferentially about the housing.

12. A progressing cavity pump or motor, comprising:

an outer sleeve-shaped tube;

a stator material molded within the outer tube;

a rotor for rotating within the stator;

an inner tube spaced radially between an outer surface of the stator and an inner surface of the stator, the inner tube including a plurality of through apertures each filled with stator material; and a pair of annular seal glands each positioned between an outer surface of the inner tube and an inner surface of the outer tube for sealing the stator material to the outer tube, each seal gland positioned adjacent an end of the inner tube and including an axially extending lip extending from a seal gland base toward a center portion of the inner tube.

13. A progressing cavity pump or motor as defined in claim 12, further comprising:

one or more intermediate annular seal glands spaced between the pair of annular seal glands adjacent the ends of the inner tube.

14. A progressing cavity pump or motor as defined in claim 12, wherein the stator material fills in a gap between the lip and the outer tube and seals between the annular seal gland and the outer tube.

15. A progressing cavity pump or motor as defined in claim 12, wherein the stator is one of a polymeric, elastomeric, or plastic material installed in the outer tube by an injection molding process.

16. A progressing cavity pump or motor as defined in claim 12, wherein the plurality of through apertures are spaced in axially extending rows and circumferentially spaced columns.

17. A progressing cavity pump or motor, comprising:

an outer sleeve-shaped tube;

a stator material molded within the outer tube;

a rotor for rotating within the stator;

an inner tube spaced radially between an outer surface of the stator and an inner surface of the stator, the inner tube including a plurality of radially extending through apertures each filled with stator material;

one or more annular seal glands each positioned between an outer surface of the inner tube and an inner surface of the outer tube for sealing the stator material to the outer tube, each of the one or more seal glands including an axially extending lip spaced radially from the outer tube; and an end section of each axially extending lip defining an inner face spaced axially between an end face of the axially extending lip and a base of the seal gland, the inner face lying substantially within a plane perpendicular to an axis of the outer tube.

18. A progressing cavity pump or motor as defined in claim 17, wherein a inner surface of the axially extending lip between the base and the inner face lies within a plane substantially perpendicular to the axis of the outer tube.

19. A progressing cavity pump or motor as defined in claim 17, wherein the one or more seal glands includes a pair of seal glands each positioned adjacent an end of the inner tube.

20. A progressing cavity pump or motor as defined in claim 19, further comprising:

one or more intermediate annular seal glands spaced between the pair of annular seal glands adjacent the ends of the inner tube.

21. A progressing cavity pump or motor as defined in claim 17, wherein the stator is one of a polymeric, elastomeric, or plastic material installed in the outer tube by an injection molding process.

22. A progressing cavity pump or motor as defined in claim 17, wherein the inner tube has a substantially uniform diameter.

* * * * *